US012064005B2

(12) United States Patent
Heitz et al.

(10) Patent No.: US 12,064,005 B2
(45) Date of Patent: Aug. 20, 2024

(54) RUNNING SHOE SOLE COMPRISING A SOFT-ELASTIC MIDSOLE

(71) Applicant: ON CLOUDS GMBH, Zürich (CH)

(72) Inventors: Ilmarin Heitz, Zürich (CH); Olivier Bernhard, Heiden (CH)

(73) Assignee: ON CLOUDS GMBH, Zurich (CH)

( * ) Notice: Subject to any disclaimer, the term of this patent is extended or adjusted under 35 U.S.C. 154(b) by 262 days.

(21) Appl. No.: 17/297,287

(22) PCT Filed: Oct. 25, 2019

(86) PCT No.: PCT/EP2019/079299
§ 371 (c)(1),
(2) Date: May 26, 2021

(87) PCT Pub. No.: WO2020/108896
PCT Pub. Date: Jun. 4, 2020

(65) Prior Publication Data

US 2022/0031017 A1 Feb. 3, 2022

(30) Foreign Application Priority Data

Nov. 27, 2018 (CH) ..... 1463/18

(51) Int. Cl.
*A43B 13/18* (2006.01)
*A43B 5/06* (2022.01)
*A43B 13/12* (2006.01)

(52) U.S. Cl.
CPC ..... *A43B 13/181* (2013.01); *A43B 5/06* (2013.01); *A43B 13/125* (2013.01)

(58) Field of Classification Search
CPC ... A43B 13/181; A43B 13/186; A43B 13/125; A43B 13/187; A43B 13/188;
(Continued)

(56) References Cited

U.S. PATENT DOCUMENTS 3,785,646 A * 1/1974 Ruskin ..... A63B 21/4015 482/79
3,834,046 A 9/1974 Fowler
(Continued)

FOREIGN PATENT DOCUMENTS

AU 657090 B2 1/1992
CN 88 1 03110 A 12/1988
(Continued)

OTHER PUBLICATIONS

EPO (Riswijk, NL), English language version of the International Search Report, Form PCT/ISA/210, for International Application PCT/EP2019/079299, Jan. 17, 2020 (2 pages).
(Continued)

*Primary Examiner* — Khoa D Huynh
*Assistant Examiner* — Haley A Smith
(74) *Attorney, Agent, or Firm* — Pauley Erickson & Swanson

(57) ABSTRACT

A sole for a running shoe with a soft-elastic midsole (1) includes an underside (2) at least partially contacting the ground (B) during running and comprises a plurality of channels (3*a*, 3*b*, 3*c*, 3*d*, 3*e*, 4*a*, 4*b*, 4*c*) extending in the transverse direction (Q). The channels (3*a*, 3*b*, 3*c*, 3*d*, 3*e*, 4*a*, 4*b*, 4*c*) are arranged in a lateral area of the midsole (1) in at least a first and a second in horizontal plane, wherein the first and second horizontal plane are vertically offset from each other, and wherein the channels (3*a*, 3*b*, 3*c*, 3*d*, 3*e*, 4*a*, 4*b*, 4*c*) are each delimited in longitudinal direction (L) by a front wall and a rear wall. The channels (3*a*, 3*b*, 3*c*, 3*d*, 3*e*, 4*a*, 4*b*, 4*c*) are vertically and/or horizontally in the longitudinal direction (L) deformable until their closure under the action of forces occurring during running acting vertically (V) and/or longitudinally.

16 Claims, 3 Drawing Sheets

(58) Field of Classification Search
CPC ..... A43B 13/141; A43B 5/06; A43B 3/0068; A43B 3/0063; A43B 3/0057
See application file for complete search history.

(56) References Cited

U.S. PATENT DOCUMENTS

| | | | | | |
|---|---|---|---|---|---|
| 4,235,026 | A * | 11/1980 | Plagenhoef | A43B 13/181 36/28 |
| 4,236,326 | A | 12/1980 | Inohara | |
| 4,451,994 | A | 6/1984 | Fowler | |
| 4,506,461 | A * | 3/1985 | Inohara | A43B 13/20 36/35 B |
| 4,536,974 | A * | 8/1985 | Cohen | A43B 13/18 36/28 |
| 5,822,886 | A | 10/1998 | Luthi et al. | |
| 6,647,645 | B2 * | 11/2003 | Kita | A43B 13/12 36/31 |
| 2004/0154189 | A1 * | 8/2004 | Wang | A43B 13/187 36/28 |
| 2005/0252038 | A1 | 11/2005 | Braunschweiler | |
| 2008/0034615 | A1 * | 2/2008 | Nishiwaki | A43B 13/181 36/28 |
| 2008/0276494 | A1 | 11/2008 | Lacorazza et al. | |
| 2009/0211114 | A1 * | 8/2009 | Ivester | A43B 21/26 36/114 |
| 2010/0223810 | A1 * | 9/2010 | Lekhtman | A43B 13/181 36/27 |
| 2011/0016746 | A1 * | 1/2011 | Callahan | A43B 13/187 36/28 |
| 2014/0259743 | A1 * | 9/2014 | Bernhard | A43B 13/127 36/28 |
| 2014/0305008 | A1 | 10/2014 | Wang et al. | |
| 2015/0230549 | A1 * | 8/2015 | Bernhard | B29D 35/061 36/25 R |
| 2021/0235813 | A1 * | 8/2021 | Hartmann | A43B 13/125 |

FOREIGN PATENT DOCUMENTS

| | | | |
|---|---|---|---|
| CN | 101299940 | A | 11/2008 |
| CN | 203789258 | U | 8/2014 |
| CN | 104095350 | A | 10/2014 |
| DE | 28 16 619 | A1 | 10/1979 |
| DE | 38 32 743 | A1 | 4/1990 |
| EP | 0299669 | | 1/1989 |
| JP | S58212401 | | 12/1983 |
| JP | 2008532618 | | 8/2008 |
| JP | 2009514578 | | 4/2009 |
| RU | 2489069 | C2 | 8/2023 |
| WO | WO2006038357 | | 5/2008 |
| WO | WO 2016/184920 | A1 | 11/2016 |

OTHER PUBLICATIONS

Fed. Inst. of Industrial Property, Moscow, English language version of Office Action, Application No. 2021114187/03(030119), Jul. 4, 2022 (04 pages).
Fed. Inst. of Industrial Property, Moscow, English language version of Search Report, Application No. 2021114187/03(030119), Jul. 4, 2022 (02 pages).
Fed. Inst. of Industrial Property, Switzerland, Swiss Search Report, Application No. CH01463/18, Mar. 1, 2019 (03 pages).
Chinese Patent Office (CNIPO), Bejing, P.R. China, Office Action for Chinese Application No. 201980079396.4, issued May 10, 2022 (6 pages).
Chinese Patent Office (CNIPO), Bejing, P.R. China, Search Report for Chinese Application No. 201980079396.4, issued May 5, 2022 (3 pages).
Fed. Inst. of Industrial Property, Brazil, Office Action, Application No. BR112021009891-7, Oct. 25, 2019 (08 pages).
Fed. Inst. of Industrial Property, Singapore, English language version of Office Action, Application No. 11202105260P, Oct. 25, 2019 (06 pages).
JPO, Office Action for Japanese Patent Application No. P2021-528377, Issued May 23, 2023 (11 pages).

* cited by examiner

RUNNING SHOE SOLE COMPRISING A SOFT-ELASTIC MIDSOLE

CROSS REFERENCE TO RELATED APPLICATION

This application is a National Phase filing in the United States, under 35 USC § 371, of PCT International Patent Application PCT/EP2019/079299, filed on 25 Oct. 2019 which claims the priority of Swiss Patent Application CH 01463/18, filed 27 Nov. 2018.

These applications are hereby incorporated by reference herein in their entirety and is made a part hereof, including but not limited to those portions which specifically appear hereinafter.

BACKGROUND OF THE INVENTION

Field of the Invention

The invention relates to the field of footwear technology, in particular, for sports and leisure footwear, and concerns a sole for a running shoe.

Discussion of Related Art

A large number of running shoes with different cushioning systems are known in the prior art. Sports and leisure shoes with soles having a gel core in the heel area to ensure vertical cushioning during tread are commonly employed. Furthermore, improvements in vertical cushioning properties have been achieved by placing individual spring elements in the heel area between the outsole and insole.

While the above-mentioned soles improve the vertical cushioning properties of the shoes, they cannot achieve satisfactory cushioning of forces acting horizontally on the sole and shoe. Forces with a large horizontal component are additionally amplified, especially on inclined routes, and due to a lack of sufficient cushioning they represent one of the main causes of frequently occurring knee and hip joint pain.

A sole is known from WO 2016/184920 of the applicant which has downwardly projecting, laterally open, segmented and channel-shaped elements. Under the effect of the forces occurring during running, the channel-shaped elements are deformable both vertically and horizontally until their lateral openings are closed. Segmentation of the sole also segments the cushioning effect, forming non-cushioned or less cushioned areas in the sole.

SUMMARY OF THE INVENTION

In many sports activities, such as running, the initial contact of the shoe with the ground occurs in the heel area. As a result, the forces acting on the shoe in this area are significantly greater than in the forefoot or midfoot area of the sole. To take this into account, running shoes generally have particularly pronounced cushioning in the heel area. Although such a design allows to provide at least sufficient vertical cushioning, the pronounced cushioning has a negative effect on the overall weight of the shoe. As a result, running shoes known in the prior art have either unsatisfactory cushioning and/or a high weight.

Another disadvantage of known running shoe soles is their low durability. Longer service life is often accompanied by a significant loss of cushioning effect. This is often caused by fatigue of the cushioning material.

In addition, known soles for running shoes often lack a cushioning effect that varies across different areas and sub-areas of the sole.

It is therefore the general objective of the invention to advance the prior art in the field of running shoes and preferably to overcome one or more disadvantages of the prior art. In advantageous embodiments, a sole with an improved cushioning effect is provided, which preferably has a low weight.

In further embodiments, hierarchical cushioning is provided from the heel area through the midfoot area to the forefoot area, and the cushioning effect is preferably non-segmented.

In further embodiments, a sole with a cushioning effect is provided that exhibits improved durability over an extended period of time.

In another embodiment, a sole is provided with cushioning that is variable across different areas and sub-areas of the shoe.

The general problem of the invention is solved in a general way by the subject-matter of the independent claim.

Further advantageous embodiments are apparent in each of the dependent patent claims, as well as in the disclosure as a whole.

The sole for a running shoe according to the invention comprises a soft-elastic midsole with an underside that is at least partially in contact with the ground. The midsole has a plurality of channels extending in a transverse direction. These channels are arranged in a lateral area of the midsole in at least a first and a second horizontal plane. Here, the first and second horizontal planes are vertically offset from each other. Further, the channels are in the longitudinal direction delimited by a front wall and a rear wall. Furthermore, the channels are vertically and/or in the longitudinal direction deformable until their closure under the action of forces occurring during running acting vertically and/or in the longitudinal direction. By arranging the channels in at least a first and a second horizontal plane, a significant improvement in the cushioning effect is achieved. In addition, due to the fact that the first and second horizontal planes are vertically offset from each other, a so-called hierarchical cushioning can be formed. Thereby, the cushioning is no longer limited to individual segments of cushioning elements, but extends essentially over the entire midsole. Hierarchical cushioning is particularly advantageous because the channels in the first horizontal plane, which is formed closer to the underside, are more flexible and can therefore be deformed more easily than the channels in the second horizontal plane. This allows an additional cushioning effect to be formed at specific points provided for this purpose, which can significantly improve both the overall cushioning effect and the wearer's comfort. This effect can be further enhanced by additional channels in further horizontal planes.

Directional indications as used in the present disclosure are to be understood as follows: A horizontal plane of the sole describes a plane which is oriented substantially parallel to the underside of the sole, or substantially parallel to the ground. It is also understood that the horizontal plane may also be slightly curved. This may be the case, for example, if the sole is slightly curved upwards vertically at the forefoot area and/or at the heel area, as is typical of running shoes. The longitudinal direction L of the sole is described by an axis from the heel area to the forefoot area and thus extends along the longitudinal axis of the sole. The transverse direction Q of the sole extends transversely to the longitudinal axis and substantially parallel to the underside of the sole, or substantially parallel to the ground. Thus, the transverse direction runs along a transverse axis of the midsole. In the context of the present invention, the vertical direction V denotes a direction from the underside of the sole towards the insole, or in the operative state towards the foot of the wearer, and thus runs along a vertical axis of the midsole.

Further, the lateral area of the midsole refers to an area along the lateral inner and outer sides of the midsole of the running shoe of a pair of running shoes, wherein this area extends in the direction of the longitudinal axis of the midsole. Typically, the horizontal extension of the lateral area is a few centimeters, for example 0.1 to 5 cm, preferably 0.5 to 3 cm. The medial area of the midsole refers to an area along the longitudinal axis at the center of the midsole, which extends in each case in the transverse direction of the midsole. Typically, the horizontal extension of the medial area is a few centimeters, for example 0.1 to 5 cm, preferably 0.5 to 3 cm.

For the purposes of the present invention, a channel is to be understood as a recess which may typically be tubular in shape. Generally, a channel is wholly or partially delimited by channel walls. Typically, the channels are empty. However, it is also possible that in some embodiments the channels are filled, for example with an elastically deformable foam or with a gas.

According to the present invention, the channels are each delimited by a front wall and a rear wall. A wall can be formed by a flat surface or by two or more surfaces which have one or more folding edges. The term "folding edge" also includes embodiments which are slightly rounded and therefore not completely angular. Consequently, such a folding edge extends along the channel and thus in the transverse direction of the midsole. In some embodiments of the invention, the front wall and/or the rear wall of a channel may be formed as a so-called stable wall. A stable wall refers to a wall which does not have a folding edge and extends substantially in the vertical direction of the central sole. A wall with a folding edge is therefore easier to deform than a stable wall.

It is clear to the person skilled in the art that the channel deformability may include, for example, bringing the channel walls together vertically and/or shearing the channel longitudinally.

In addition, the phrase "underside coming into contact with the ground when running" also includes embodiments in which the midsole is coated with a further layer, for example an outsole. In such cases, contact with the ground is established at least in part by means of such an outsole.

In a preferred embodiment, the soft-elastic midsole is formed in one piece. The soft-elastic midsole thus preferably consists of a single material and is therefore more stable than a midsole consisting of several components, in particular components bonded or welded together.

In a preferred embodiment, the channels have lateral openings in the lateral area of the midsole. Preferably, the channels are vertically and/or horizontally in the longitudinal direction deformable under the action of forces occurring during running acting vertically and/or in the longitudinal direction until the lateral openings are closed.

Typically, the upper and lower channel walls can contact each other under the effect of the forces that occur during running.

In typical embodiments, the channels may have an elongated shape in cross-section in the longitudinal direction.

Preferably, the channels in the lateral area of the midsole are completely delimited by the soft-elastic midsole. In such an embodiment, the channel walls can consequently be formed entirely by the midsole in the lateral area of the midsole. Typically, therefore, in the side view of the sole, the channels may be described as transverse openings in an otherwise preferably one-piece midsole. In preferred embodiments, the midsole has no segmentation. This can significantly improve the durability of the sole, as the midsole is generally designed to be significantly more stable compared to a segmented midsole. Furthermore, fatigue of the soft-elastic midsole is avoided, or at least significantly reduced, over the usage time of the sole, or of the running shoe. As a result, the advantageous cushioning effect of the midsole can be maintained constantly over a long period of time.

In another embodiment, the channels in a medial area of the midsole are delimited on one side by a layer extending across the heel area, the midfoot area and the forefoot area. Preferably, the at least one side is the side facing the wearer's foot in the operative state. Consequently, in such an embodiment, the channels may have a substantially U-shaped or V-shaped cross-section in the medial area of the midsole. Alternatively, the cross-section can also be described by an upwardly open trapezoid.

Typically, the layer extending over the heel area, the midfoot area and the forefoot area consists of an elastic and incompressible plate.

In a preferred embodiment, the midsole comprises a groove extending longitudinally from the heel area to at least the midfoot area. Typically, the groove extends only into the midfoot area. However, it is also possible for the groove to extend through substantially the entire midsole and for the groove to be connected only at the tip of the sole and the heel end. Typically, the channel is open towards the ground and is delimited at the lateral flanks by the soft-elastic midsole and at the base either by the insole of the running shoe or else by a layer described above. The groove is particularly preferably essentially V-shaped so that the flanks are inclined. This prevents stones and pieces of wood from being trapped. The channels in the transverse direction in the middle sole can preferably be open towards the groove.

An embodiment in which the groove extends from the heel to the midfoot area has proved as particularly advantageous. The groove allows better deformability of the channels, which is particularly advantageous with thicker wall thicknesses, as it is preferably provided in the heel and midfoot area. In the forefoot area, on the other hand, a much weaker cushioning effect is typically required, which is why the channel walls in this area are provided with a much thinner wall thickness and are thus easier to deform than the channels in the heel and midfoot areas.

In a further embodiment, at least one channel has an inclination in the vertical direction. Typically, the vertical inclination of the channels runs in the transverse direction, and may in particular increase from the lateral area towards the medial area. A channel having such an inclination may typically be arranged in the lateral area of the midsole in the first horizontal plane and, due to the inclination, may be arranged in the medial area in a further, third horizontal plane vertically offset from the first horizontal plane. Similarly, a channel may be disposed in the lateral area of the midsole in the second horizontal plane and, due to the inclination in the medial area, may be arranged in a further, fourth horizontal plane vertically offset from the second horizontal plane. While the first and second horizontal planes are vertically offset from each other, it is possible for the third and fourth horizontal planes to be identical, i.e., not vertically offset from each other. However, it is also possible that the third and fourth horizontal planes are also vertically offset from each other.

In a preferred embodiment, all channels in the heel area and midfoot area have a vertical inclination. Such a vertical inclination of the channels in the heel area and midfoot area has the advantage that the stability in these areas is increased and a possible floating effect is reduced or avoided. Typically, the vertical inclination of the channels runs in the transverse direction, and can increase in particular from the lateral area to the medial area.

Preferably, the midsole has a groove extending longitudinally from the heel area into the midfoot area, as described above. In addition, all of the channels in the heel and midfoot areas may have a vertical inclination. Here, the channels may be open in the transverse direction of the midsole towards the groove.

Typically, the vertical inclination may be an upward inclination, i.e., the channel rises towards the foot of the wearer in the operative state. For example, the channels in the lateral area of the midsole may be arranged in a first, lower horizontal plane and a second, upper horizontal plane, and by the inclination in the medial area may be arranged in a third, respectively fourth, horizontal plane, the third, respectively fourth, horizontal plane being arranged vertically above the first and second horizontal planes.

Particularly preferably, the channel is formed in the lateral area of the midsole entirely by the midsole and only partially by the midsole in the medial area, so that in the medial area at least one side of the channel, typically the upper side, i.e. the side facing the wearer's foot in the operative state, is delimited by a layer extending over the heel area, the midfoot area and the forefoot area. The vertical inclination may be located between the lateral and medial areas or may be located partially in the medial and partially in the lateral area of the midsole.

A midsole according to the invention with one or more channels having a vertical inclination has several advantages. Firstly, this enables efficient cushioning in the lateral area of the midsole. At the same time, however, the stability of the sole is also increased, so that the so-called floating effect associated with horizontal deformation is prevented or at least reduced. Another advantage is the generally increased stability of the medial area of the midsole, resulting in an improved and more stable running feeling. In embodiments with a groove described above, any instabilities associated with the groove are prevented by one or more vertically rising channels.

In a preferred embodiment, a width of the soft-elastic midsole between at least one channel and the underside is thinner in the lateral area of the midsole than in the medial area of the midsole. This makes the medial area of the midsole more stable. Furthermore, the usage time of the running shoe, or of the sole, can be significantly increased, since fatigue of the soft-elastic midsole is avoided or at least significantly reduced over the usage time.

Particularly preferred is an embodiment in which the width of the soft-elastic midsole between each channel in the heel and midfoot area and the underside is thinner in the lateral area of the midsole than in the medial area of the midsole.

In a typical embodiment, the channels of the first horizontal plane are offset horizontally in the longitudinal direction relative to the channels of the second horizontal plane. This additionally enhances the effect of hierarchical cushioning. For example, the channels can be arranged in such a way that during tread with the heel, a channel in the first horizontal plane is deformed first. This channel would consequently be the first channel in the transverse direction as seen from the heel area in the running direction. The subsequent second channel may then be vertically offset upwards in the second horizontal plane and horizontally arranged in the direction of the tip of the sole. Accordingly, the following third channel in the transverse direction would again be arranged in the first horizontal plane and horizontally offset with respect to the second channel in the direction of the sole tip. Such an alternating arrangement may extend along the entire length of the sole, or preferably only along the heel area and midfoot area. The offset in the horizontal direction of the channels in the first and second horizontal planes has several advantages. For example, the hierarchical arrangement means that the cushioning is no longer limited to individual segments of cushioning elements, but instead extends over substantially the entire midsole. The channels in the second horizontal plane, which are generally arranged above, i.e., in the operative state in the direction of the wearer's foot, the first horizontal plane, can due to their positioning only be deformed with greater force than the channels in the underlying, first horizontal plane. Thus, the channels of the second horizontal plane are suitable for increasing the cushioning effect in areas subject to particular stress, such as the heel and midfoot area. By offsetting the channels horizontally, the overall width and thus the weight of the midsole can be minimized without having a negative impact on the cushioning effect.

In a preferred embodiment, the channels in the forefoot area are arranged in a single horizontal plane only. In general, the additional cushioning effect provided by the arrangement of channels in the transverse direction in a second horizontal plane, which is arranged above the first horizontal plane, is only required in heavily stressed areas of the sole, such as the heel area and midfoot area, so that channels in the second horizontal plane in the forefoot area can be dispensed with.

In a further embodiment, the channels have a hexagonal and/or pentagonal cross-section, in particular, preferably in the lateral area of the soft-elastic midsole. Typically, at least one corner of the penta- or hexagon is arranged in the longitudinal direction, i.e., in or against the running direction. For example, one corner of the penta-or hexagon may be arranged in the running direction towards the tip of the sole or opposite to the running direction towards the end of the sole. In addition, the penta- or hexagon can comprise an asymmetry, for example, the sides of the penta- or hexagon in the running direction, i.e., sides which are essentially parallel to the ground, can be longer than the other sides of the penta- or hexagon. This gives the channels an elongated shape in cross-section.

Particularly preferably, the channels have two sides in cross-section that are essentially parallel to each other and to the ground or underside. The angular shape of the channels in cross-section has positive effects on the deformability of the channels. Thus, the hexagonal shape is preferably suitable for channels which are arranged in the second, upper horizontal plane, as these have a lower deformability due to their position. This deformability can be increased to a certain extent by the hexagonal shape. Consequently, due to the correct shape of the channels, the deformability of each individual channel can be individually and flexibly adapted to its position and to the specific forces acting on the channel.

The channels typically have in the lateral area of the midsole a height (extension of the channels in the vertical direction) of 2 to 10 mm and a length (extension of the channels in the longitudinal direction) of 5 to 35 mm, preferably 10 to 30 mm.

In a further embodiment, the front wall of at least one channel has a folding edge in the first horizontal plane in the heel area. In addition, the rear wall of the at least one channel in the first horizontal plane in the heel area is formed as a stable wall. Therefore, the rear wall does not have a folding edge and preferably comprises an edgeless surface. Such an embodiment has proven to be particularly advantageous, since the initial contact of the shoe during tread in the heel area causes the strongest forces to act on the rear wall of the at least one channel in the heel area. The rear wall formed in this way causes that these relatively strong forces can be efficiently absorbed. Furthermore, the folding edge on the front wall of the at least one channel in the heel area allows the channel to deform until it closes under the forces that occur during running.

For example, in this embodiment, the cross-section of the respective at least one channel may be pentagonal in shape, with one corner of the pentagon facing in the running direction towards the tip of the sole and one side of the pentagon being disposed in the rear wall.

However, it is conversely also possible for the rear wall of at least one channel in the first horizontal plane in the heel area to comprise a folding edge and for the front wall of the at least one channel in the first horizontal plane in the heel area to be formed as a stable wall. This can be useful, for example, for providing an alternative cushioning profile if required.

In a preferred embodiment, the front wall of at least one channel in the first horizontal plane in the front foot area is designed as a stable wall. In addition, the rear wall of the at least one channel in the first horizontal plane in the front foot area comprises a folding edge. Therefore, the front wall does not have a folding edge and preferably consists of an edgeless surface. The greatest forces acting on the front foot area come from the push-off of the runner. It has therefore proved particularly advantageous for the front wall of the at least one channel to be designed as a stable wall in this area and not to have a folding edge. This ensures that the push-off force emanating from the runner can be used practically completely for the push-off and is not absorbed by the sole. Since at the same time the rear wall of the at least one channel in the forefoot area has a folding edge, an excellent cushioning effect is nevertheless also ensured in this area during tread and rolling.

Conversely, however, it is also possible for the front wall of at least one channel in the first horizontal plane in the front foot area to have a folding edge and for the rear wall of the at least one channel in the first horizontal plane in the front foot area to be formed as a stable wall. This can be useful, for example, for providing an alternative cushioning profile if required.

In a further embodiment, the front wall and the rear wall of at least one channel each have a folding edge in the first horizontal plane in the midfoot area. Relatively low forces occur at least in a part of the midfoot area, since a large part of the forces are already absorbed in the heel area when during tread, and a large part of the push-off acts on the forefoot area of the sole. Thus, it has proven advantageous to increase the deformability of at least one channel in the midfoot area by providing both the front and rear walls with a folding edge.

Particularly preferably, hexagonal channels can be provided in cross-section for this purpose, which have an elongated shape in the longitudinal direction.

Preferably, the front wall and the rear wall of at least one channel, preferably all channels, each have a folding edge in the second horizontal plane. This is advantageous because it increases the deformability of the channels in the second, upper horizontal plane, which, due to their positioning within the midsole, generally have a lower deformability than the channels in the first, lower horizontal plane.

In another embodiment, the channels in the heel area and midfoot area have a vertical inclination, while the channels in the forefoot area have no vertical inclination. The additional stability provided by the vertical inclination is of great advantage, especially in areas subject to high stress, such as the heel area and/or parts of the midfoot area. In the forefoot area, on the other hand, this is not absolutely necessary, so that the additional complexity in this area of the sole can be dispensed with. For example, the channels in the forefoot area can cross the midsole completely in the transverse direction while lying in essentially a horizontal plane. It is additionally possible for example that in the lateral area of the midsole in the area of the forefoot, the channels are completely delimited by the soft-elastic midsole and in the medial area are delimited by a layer on one side, preferably the upper side, i.e., the side facing the wearer's foot in the operative state. Typically, this is an insole or an elastic, incompressible plate of the type already described.

BRIEF DESCRIPTION OF SEVERAL VIEWS OF THE DRAWINGS

Aspects of the invention are explained in more detail with reference to the embodiments shown in the following figures and the accompanying description.

DETAILED DESCRIPTION OF THE INVENTION

Figure 1:
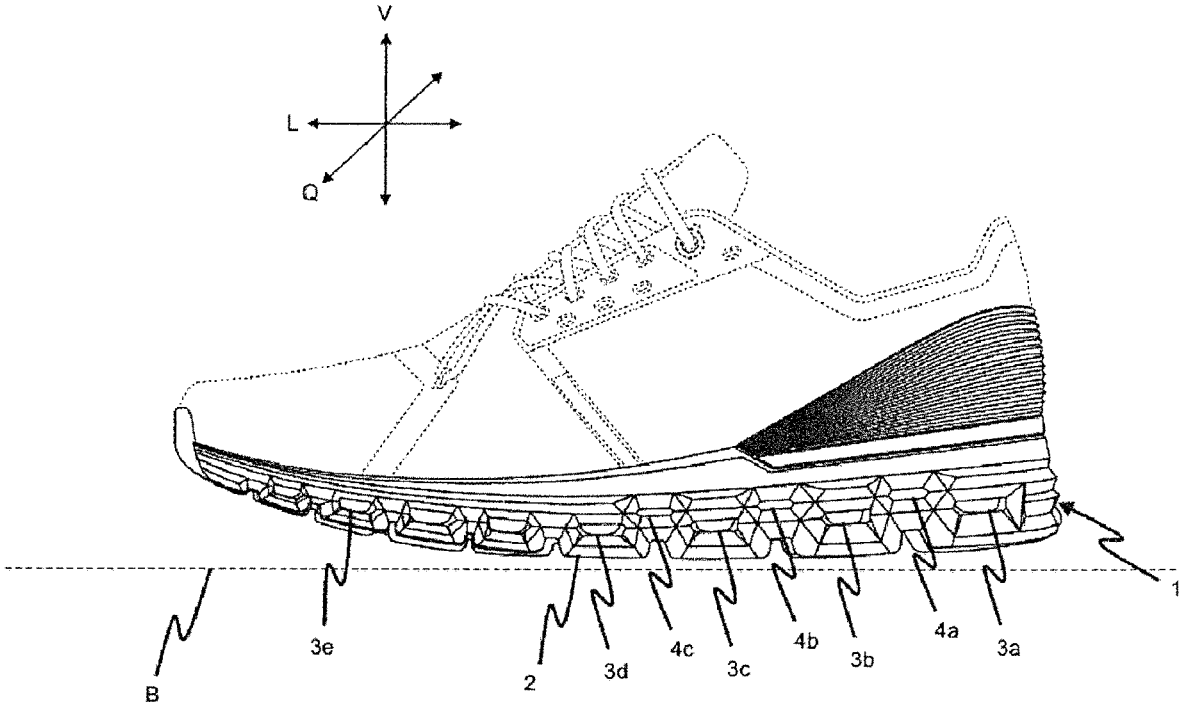
FIG. 1 shows a schematic side view of a sole for a running shoe according to one embodiment of the invention.

The schematic side view shown in FIG. 1 shows an embodiment of a sole for a running shoe with a soft-elastic midsole 1. The soft-elastic midsole is shown from the outer side and has an underside 2 which comes into contact with the ground B shown as a dashed line during running. Furthermore, the midsole 1 comprises several channels 3*a*, 3*b*, 3*c*, 3*d*, 3*e*, 4*a*, 4*b* and 4*c* running in the transverse direction Q in a lateral area of the midsole (for better clarity, not all channels of the sole shown according to the invention are designated). FIG. 1 shows the lateral area of the midsole in plain view. The channels 3*a*, 3*b*, 3*c*, 3*d* and 3*e*, are arranged in a first horizontal plane as shown. Since the sole is slightly curved upwards at the tip in the vertical direction (V), the first horizontal plane has a slight curvature, in the present case a convex curvature as seen from the ground.

The soft-elastic midsole further comprises channels 4*a*, 4*b* and 4*c*, which are arranged in a second horizontal plane. The two horizontal planes are arranged offset to each other in vertical direction V. Based on the coordinate system, it is clear that the horizontal planes lie essentially, i.e., taking into account the slightly vertical curvature of the midsole, in the plane of the transverse Q and longitudinal direction L of the midsole. In the embodiment shown, the channels of the first horizontal plane extend over the entire length of the soft-elastic midsole, and the channels of the second horizontal plane extend only over the heel and midfoot area. However, it is also conceivable that channels in the second horizontal plane are also arranged in the forefoot area.

The first horizontal plane forms the lower plane, i.e., the plane which is positioned closer to the underside 2, and the second horizontal plane forms the upper plane, i.e., the plane which is positioned closer to the foot of the wearer in the operative state. In the embodiment shown, the channels 3*a*, 3*b*, 3*c*, 3*d*, 3*e*, 4*a*, 4*b* and 4*c* each have a lateral opening in the lateral area of the midsole 1. In the operative state, these can be deformed until their closure by the forces occurring during running. Closure can occur in this case in essentially by vertical deformation and/or also by horizontal deformation in the longitudinal direction, i.e., by shearing of the channels. Moreover, the channels 3*a*, 3*b*, 3*c*, 3*d*, 3*e*, 4*a*, 4*b* and 4*c* are completely delimited in the lateral area of the midsole 1 by the soft-elastic midsole 1. Thus, all channel walls in the lateral area are formed by the soft-elastic midsole.

In the embodiment shown in FIG. 1, the channels 3*a*, 3*b*, 3*c*, 3*d* and 3*e* of the first horizontal plane are arranged horizontally offset in the longitudinal direction relative to the channels 4*a*, 4*b* and 4*c* of the second horizontal plane. Since the initial contact of the sole typically occurs at the heel, the first channel 3*a* is deformed first. Then, during the treading and rolling process, the deformation of the second channel 4*a*, then the third channel 3*b*, the fourth channel 4*b*, the fifth channel 3*c*, etc., occurs sequentially. Due to their positioning within sole 1, the channels in the second horizontal plane 4*a*, 4*b* and 4*c* can only be deformed with greater force than the channels 3*a* to *e* of the lower horizontal plane.

Figure 2:
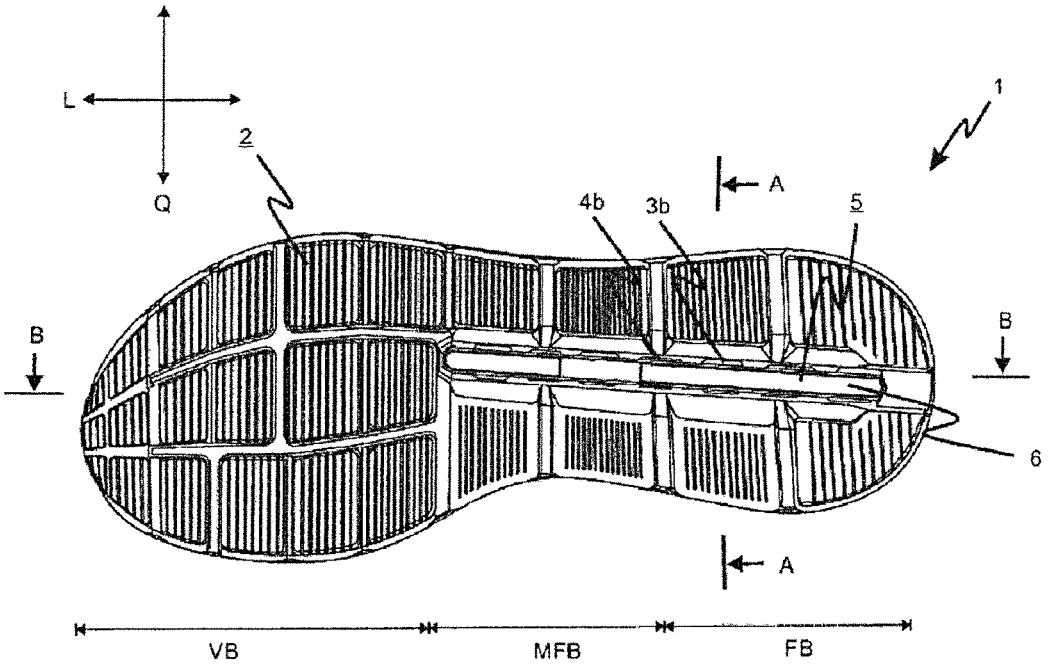
FIG. 2 shows a view on the underside of a sole according to the invention for a running shoe according to a further embodiment of the invention.

FIG. 2 shows a view of the underside 2 of a midsole 1 according to one embodiment of the invention. In addition, a division of the midsole into a forefoot area VB, a midfoot area MFB and a heel area FB is shown. This serves merely as a guideline for the person skilled in the art and is not intended to define the exact boundaries of the areas. The midsole 1 shown has a groove 6 extending from the heel area into the midfoot area. The groove is open towards the ground B, i.e., towards the viewer in the illustrated view of FIG. 2, and is delimited at the lateral flanks by the soft-elastic midsole 1 and at the base by a layer 5. It can also be seen that the lateral flanks are inclined so that the groove 6 is open in a V-shape towards the viewer. Furthermore, channels, such as channels 3*b* and 4*b*, are visible, which are open towards the groove and open into it.

Figure 3:
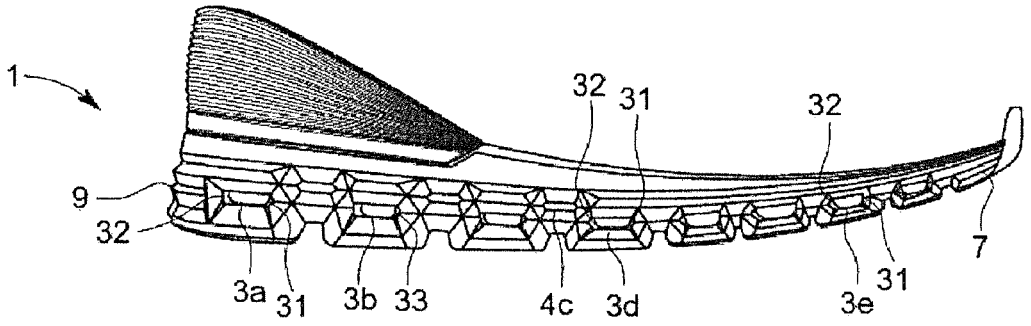
FIG. 3 shows a schematic side view of a sole according to the invention for a running shoe according to a further embodiment of the invention.

FIG. 3 shows an embodiment of a sole according to the invention for a running shoe with a soft-elastic midsole 1. The channels 3*a*, 3*d*, 3*e* and 4*c* (as well as the remaining channels shown but not designated for clarity) each have a front wall 31 and a rear wall 32. In addition, the channels in the lateral area of the soft-elastic midsole 1 are pentagonal or hexagonal in cross-section.

Channel 3*a*, which is located in the heel area, has a pentagonal cross-section, with one corner of the pentagon being located in the longitudinal direction and in the running direction, i.e., in the direction of the tip of the sole 7. The pentagon is also formed asymmetrically, since the sides of the pentagon in the longitudinal direction are formed longer than the other sides of the pentagon. Therefore, the channel has a flat shape. The sides of the pentagon in the longitudinal direction are also formed parallel to each other and substantially parallel to the bottom, or parallel to the underside. Furthermore, the front wall 31 of the channel 3*a* has a folding edge which corresponds in cross-section to the corner of the pentagon arranged in running direction towards the tip of the sole 7. For a better overview, the folding edge 33 is only referenced in the channel 3*b* with a reference sign in FIG. 3. The rear wall 32 is designed as a stable wall and therefore has no folding edge.

The channel 3*d*, which is arranged in the midfoot area and in the first horizontal plane, and the channel 4*c*, which is arranged in the midfoot area of the second horizontal plane, each have a hexagonal cross section. Thereby, one corner of the hexagon appoints in the longitudinal direction in the running direction and one corner points in the longitudinal direction opposite to the running direction. The respective hexagon is formed asymmetrically, since the sides of the hexagon in the longitudinal direction are formed longer than the other sides of the hexagon. Therefore, the channel has a flat shape. In addition, both the front wall 31 and the rear wall 32 of the channels 3*d* and 4*c* each have a folding edge. These folding edges correspond in cross-section to the corners of the hexagon arranged in the running direction towards the tip 7 of the sole and against the running direction towards the end 9 of the sole.

The channel 3*e*, which is arranged in the forefoot area of the soft-elastic midsole and in the first horizontal plane, has in cross section, like channel 3*a*, the shape of an asymmetrical pentagon. However, channel 3*e* is formed such that one corner of the pentagon is arranged in the longitudinal direction and opposite to the running direction. Furthermore, the rear wall 32 of the channel 3*e* has a folding edge which corresponds in cross-section to the corner of the pentagon arranged opposite to the running direction to the sole end 9 of the midsole. The front wall 31, on the other hand, is designed as a stable wall and therefore does not have a folding edge.

Figure 4:
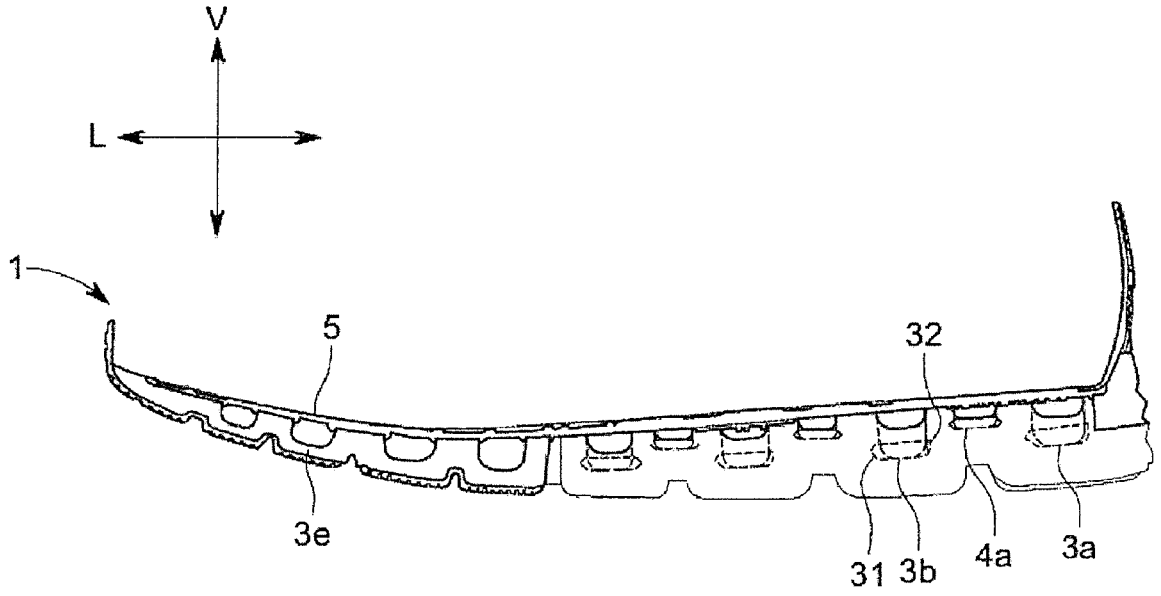
FIG. 4 shows a schematic sectional view along the longitudinal direction (along BB according to FIG. 2) of a sole according to the invention for a running shoe according to a further embodiment of the invention.

FIG. 4 shows a schematic section in the longitudinal direction of a further embodiment of the sole according to the invention for a running shoe with a soft-elastic midsole 1. In the heel area, the channels 3*a*, 3*b* and 4*a* in the lateral area of the midsole are indicated as dashed lines. The channels have an inclination in the vertical direction, and due to this inclination are arranged in the medial area in a further third, respectively fourth horizontal plane. The third and fourth horizontal planes are identical, i.e., not offset from each other in the vertical direction. However, the third and fourth horizontal planes are offset from both the first and second horizontal planes in the vertical direction. The channels 3*a*, 3*b* and 4*a* are each shown as solid lines in the medial area. While the channels in the lateral area of the midsole 1 are completely delimited by the midsole, they are only partially delimited by the midsole in the medial area and are delimited on the upper side by a layer 5.

The channel 3*e*, which is located in the forefoot area, has no inclination in the medial area. However, channel 3*e* is also only partially delimited in the medial area by the soft-elastic midsole 1. On the upper side, the channel 3*e* is limited by the layer 5.

Figure 5:
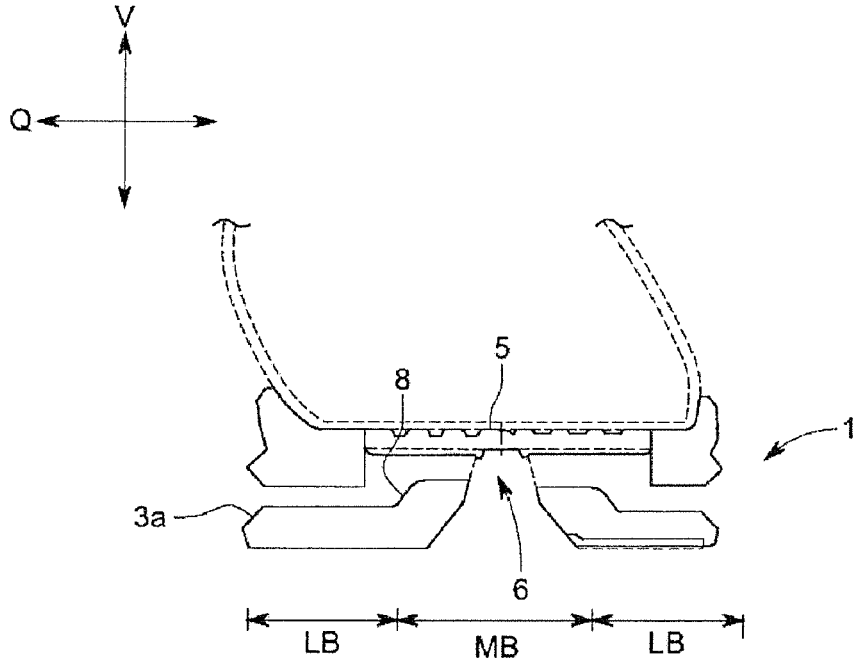
FIG. 5 shows a schematic sectional view along the transverse direction (along AA according to FIG. 2) of a sole according to the invention for a running shoe according to a further embodiment of the invention.

FIG. 5 shows a further embodiment of a sole according to the invention for a running shoe with a soft-elastic midsole 1. FIG. 5 also shows a schematic division of the midsole into the lateral area LB and the medial area MB. These areas extend in the transverse and longitudinal directions as well as in the vertical direction. However, the shown arrows do not define precise area boundaries. FIG. 5 is a cross-section of the midsole 1 through the channel 3*a* of the first horizontal plane, which is completely delimited in the lateral area by the soft-elastic midsole 1. The channel also has an inclination 8 in the vertical direction upwards, i.e., in the operative state towards the wearer's foot. In the medial area, the channel 3*a* is only partially delimited by the soft-elastic midsole, since the upper boundary of the channel 3*a* in the medial area is formed by the layer 5. The midsole also has a groove 6, which is delimited by the midsole and the layer 5. The groove 6 is essentially V-shaped in this case.

The invention claimed is:

1. A sole for a running shoe having a soft-elastic midsole (1) which has an underside (2) which comes at least partially into contact with the ground (B) during running, the midsole (1) comprising:

a plurality of channels (3*a*, 3*b*, 3*c*, 3*d*, 3*e*, 4*a*, 4*b*, 4*c*) extending in a transverse direction (Q), the channels (3*a*, 3*b*, 3*c*, 3*d*, 3*e*, 4*a*, 4*b*, 4*c*) being arranged in a lateral area of the midsole (1) in at least a first and a second horizontal plane, wherein the first and second horizontal plane are vertically offset from one another, wherein the channels (3*a*, 3*b*, 3*c*, 3*d*, 3*e*) of the first horizontal plane are horizontally in a longitudinal direction offset from the channels (4*a*, 4*b*, 4*c*) of the second horizontal plane and longitudinally adjacent channels (3*a*, 3*b*, 3*c*, 3*d*, 3*e*, 4*a*, 4*b*, 4*c*) are alternatingly offset both vertically and horizontally, and wherein the channels (3*a*, 3*b*, 3*c*, 3*d*, 3*e*, 4*a*, 4*b*, 4*c*) are each delimited in the longitudinal direction (L) by a front wall (31) and a rear wall (32) and the channels (3*a*, 3*b*, 3*c*, 3*d*, 3*e*, 4*a*, 4*b*, 4*c*) in the lateral area of the midsole (1) are completely delimited by the soft-elastic midsole (1), and wherein the channels (3*a*, 3*b*, 3*c*, 3*d*, 3*e*, 4*a*, 4*b*, 4*c*) are vertically and/or horizontally in the longitudinal direction (L) deformable until their closure under the action of forces occurring during running, acting vertically (V) and/or in the longitudinal direction, and wherein the channels (3*a*, 3*b*, 3*c*, 3*d*, 3*e*, 4*a*, 4*b*, 4*c*) in a medial area of the midsole (1) are delimited on one side by a layer extending over at least one of a heel area (FB), a midfoot area (MB) and a forefoot area (VB), the layer (5) comprising an elastic incompressible plate.

2. The sole according to claim 1, wherein the channels (3*a*, 3*b*, 3*c*, 3*d*, 3*e*, 4*a*, 4*b*, 4*c*) have lateral openings in the lateral area of the midsole (1), and wherein the channels (3*a*, 3*b*, 3*c*, 3*d*, 3*e* 4*a*, 4*b*, 4*c*) are vertically and/or horizontally in the longitudinal direction deformable under the action of forces occurring during running acting vertically and/or in the longitudinal directional until the lateral openings are closed.

3. The sole according to claim 1, wherein the channels (3*a*, 3*b*, 3*c*, 3*d*, 3*e*, 4*a*, 4*b*, 4*c*) have an elongated shape in cross-section.

4. The sole according to claim 1, wherein the midsole (1) has a groove (6) extending longitudinally from a heel area (FB) to at least a midfoot area (MB).

5. The sole according to claim 1, wherein at least one channel (3*a*, 3*b*, 3*c*, 3*d*, 3*e*, 4*a*, 4*b*, 4*c*) has an inclination (8) in the vertical direction.

6. The sole according to claim 1, wherein a width of the soft-elastic midsole (1) between at least one channel (3*a*, 3*b*, 3*c*, 3*d*, 3*e*, 4*a*, 4*b*, 4*c*) and the underside is thinner in the lateral area of the midsole than in a medial area of the midsole.

7. The sole according to claim 1, wherein the channels (3*a*, 3*b*, 3*c*, 3*d*, 3*e*) of the first horizontal plane are horizontally in the longitudinal direction offset from the channels (4*a*, 4*b*, 4*c*) of the second horizontal plane.

8. The sole according to claim 1, wherein the channels (3*e*) in a forefoot area (VB) are arranged in a single horizontal plane only.

9. The sole according to claim 1, wherein the channels (3*a*, 3*b*, 3*c*, 3*d*, 3*e*, 4*a*, 4*b*, 4*c*) have a hexagonal and/or pentagonal cross-section.

10. The sole according to claim 1, wherein the front wall (31) of at least one channel (3*a*, 3*b*) in the first horizontal plane in a heel area (FB) has a folding edge (33) and the rear wall (32) of the at least one channel (3*a*, 3*b*) in the first horizontal plane in the heel area (FB) is formed as a stable wall.

11. The sole according to claim 1, wherein the front wall (31) of at least one channel (3*e*) in the first horizontal plane in a front foot area (VB) is formed as a stable wall and the rear wall (32) of the at least one channel (3*e*) in the first horizontal plane in the front foot area (VB) has a folding edge (33).

12. The sole according to claim 1, wherein the front wall (31) and the rear wall (32) of at least one channel (3*d*) each have a folding edge (33) in the first horizontal plane in a midfoot area (MB).

13. The sole according to claim 1, wherein the front wall (31) and the rear wall (32) of at least one channel (4*a*, 4*b*, 4*c*) in the second horizontal plane each have a folding edge (33).

14. The sole according to claim 1, wherein the channels (3*a*, 3*b*, 3*c*, 3*d*, 4*a*, 4*b*, 4*c*) in a heel area (FB) and midfoot area (MB) have an inclination (8) in the vertical direction and the channels (3*e*) in a forefoot area (VB) have no inclination in the vertical direction.

15. A sole for a running shoe having a soft-elastic midsole (1) which has an underside (2) which comes at least partially into contact with the ground (B) during running, the midsole (1) comprising: a plurality of channels (3*a*, 3*b*, 3*c*, 3*d*, 3*e*, 4*a*, 4*b*, 4*c*) extending in a transverse direction (Q), the channels (3*a*, 3*b*, 3*c*, 3*d*, 3*e*, 4*a*, 4*b*, 4*c*) being arranged in a lateral area of the midsole (1) in at least a first and a second horizontal plane, wherein the first and second horizontal plane are vertically offset from one another, wherein the channels (3*a*, 3*b*, 3*c*, 3*d*, 3*e*) of the first horizontal plane are horizontally in a longitudinal direction offset from the channels (4*a*, 4*b*, 4*c*) of the second horizontal plane and longitudinally adjacent channels (3*a*, 3*b*, 3*c*, 3*d*, 3*e*, 4*a*, 4*b*, 4*c*) are alternatingly offset both vertically and horizontally, and wherein the channels (3*a*, 3*b*, 3*c*, 3*d*, 3*e*, 4*a*, 4*b*, 4*c*) are each delimited in the longitudinal direction (L) by a front wall (31) and a rear wall (32) and the channels (3*a*, 3*b*, 3*c*, 3*d*, 3*e*, 4*a*, 4*b*, 4*c*) in the lateral area of the midsole (1) are completely delimited by the soft-elastic midsole (1), and wherein the channels (3*a*, 3*b*, 3*c*, 3*d*, 3*e*, 4*a*, 4*b*, 4*c*) are vertically and/or horizontally in the longitudinal direction (L) deformable until their closure under the action of forces occurring during running, acting vertically (V) and/or in the longitudinal direction, wherein at least one channel (3*a*, 3*b*, 3*c*, 3*d*, 3*e*, 4*a*, 4*b*, 4*c*) has an inclination (8) in the vertical direction.

16. The sole according to claim 15, wherein the channels (3*a*, 3*b*, 3*c*, 3*d*, 3*e*, 4*a*, 4*b*, 4*c*) in a medial area of the midsole (1) are delimited on one side by a layer extending over a heel area (FB), a midfoot area (MB) and a forefoot area (VB), the layer (5) comprising an elastic incompressible plate.

* * * * *